US009394494B2

(12) United States Patent
Joseck et al.

(10) Patent No.: US 9,394,494 B2
(45) Date of Patent: Jul. 19, 2016

(54) PRODUCTION OF LUBRICATING OIL BASESTOCKS

(75) Inventors: Eric D. Joseck, Burke, VA (US); Michael Brian Carroll, Mantua, NJ (US); David Mentzer, Marshall, VA (US); Teck-Mui Hoo, Centreville, VA (US); Michel Daage, Hellertown, PA (US); Ajit Bhaskar Dandekar, Vienna, VA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 825 days.

(21) Appl. No.: 13/547,156

(22) Filed: Jul. 12, 2012

(65) Prior Publication Data

US 2013/0092598 A1 Apr. 18, 2013

Related U.S. Application Data

(60) Provisional application No. 61/509,621, filed on Jul. 20, 2011.

(51) Int. Cl.

| | |
|---|---|
| ***C10G 65/12*** | (2006.01) |
| ***C10G 65/14*** | (2006.01) |
| ***C10G 45/62*** | (2006.01) |
| ***C10G 45/64*** | (2006.01) |

(Continued)

(52) U.S. Cl.

CPC ..... *C10G 65/12* (2013.01); *C10G 45/60* (2013.01); *C10G 45/62* (2013.01); *C10G 45/64* (2013.01); *C10G 47/14* (2013.01); *C10G 49/22* (2013.01); *C10G 65/14* (2013.01); *C10G 2300/1074* (2013.01); *C10G 2300/202* (2013.01); *C10G 2300/301* (2013.01); *C10G 2300/302* (2013.01); *C10G 2300/304* (2013.01); *C10G 2400/04* (2013.01); *C10G 2400/10* (2013.01)

(58) Field of Classification Search

CPC ..... C10G 45/58; C10G 45/62; C10G 45/64; C10G 47/12; C10G 47/14; C10G 65/12; C10G 65/14

See application file for complete search history.

(56) References Cited

U.S. PATENT DOCUMENTS

| | | | | |
|---|---|---|---|---|
| 3,790,472 A | | 2/1974 | White | |
| 3,876,522 A | * | 4/1975 | Campbell | C10G 65/12 208/18 |

(Continued)

FOREIGN PATENT DOCUMENTS

| | | |
|---|---|---|
| EP | 0272729 A1 | 6/1988 |
| WO | 9802503 A1 | 1/1998 |
| WO | 2011001914 A1 | 1/2011 |

OTHER PUBLICATIONS

VP Lubricant Base Oils, PBF Holding Company LLC, Apr. 12, 2013.*

(Continued)

*Primary Examiner* — Renee E Robinson

(74) *Attorney, Agent, or Firm* — Robert A. Migliorini

(57) ABSTRACT

Methods are provided for producing multiple lubricating oil basestocks from a feedstock. Prior to dewaxing, various fractions of the feedstock are exposed to hydrocracking conditions of different severity to produce a higher overall yield of basestocks. The hydrocracking conditions of different severity can represent exposing fractions of a feedstock to different processing conditions, exposing fractions of a feedstock to different amounts of hydrocracking catalyst, or a combination thereof.

16 Claims, 7 Drawing Sheets

(51) Int. Cl.

| | |
|---|---|
| ***C10G 47/14*** | (2006.01) |
| ***C10G 49/22*** | (2006.01) |
| ***C10G 45/60*** | (2006.01) |

(56) References Cited

U.S. PATENT DOCUMENTS

| | | | | |
|---|---|---|---|---|
| 4,011,154 | A | 3/1977 | Stangeland et al. | |
| 5,122,257 | A * | 6/1992 | Van Helden et al. | 208/49 |
| 6,884,339 | B2 | 4/2005 | Benazzi et al. | |
| 7,300,900 | B2 | 11/2007 | Benazzi et al. | |
| 2010/0187155 | A1 | 7/2010 | McCarthy et al. | |

OTHER PUBLICATIONS

Group II/II+ Typical Properties, Chevron, Sep. 2014.*

The International Search Report and Written Opinion of PCT/US2012/046394 dated Oct. 24, 2012.

* cited by examiner

PRODUCTION OF LUBRICATING OIL BASESTOCKS

CROSS-REFERENCE TO RELATED APPLICATION

This application claims priority to U.S. Provisional Application Ser. No. 61/509,621 filed Jul. 19, 2011, herein incorporated by reference.

FIELD

Systems and methods are provided for processing of sulfur- and/or nitrogen-containing feedstocks to produce lubricating oil basestocks.

BACKGROUND

Hydrocracking of hydrocarbon feedstocks is often used to convert lower value hydrocarbon fractions into higher value products, such as conversion of vacuum gas oil (VGO) feedstocks to diesel fuel and lubricants. One type of common reaction scheme is to use hydrocracking and dewaxing to convert a VGO feedstock into at least one lubricant basestock. A hydrocracking process can be used to convert the feed to lower boiling point molecules, saturate olefins, saturate aromatics, and/or open aromatic rings. This type of conversion process typically also results in an increase in viscosity index (VI) for the feed before it is dewaxed. The hydrocracking process can further remove contaminants from the feed, such as sulfur and nitrogen. The resulting hydrocracked and dewaxed product can be fractionated into multiple basestocks using a fractionator.

U.S. Pat. No. 4,011,154 describes a method for processing a feed to produce multiple basestocks, where the viscosity index spread of the basestocks is less than a desired value. In an example, a feedstock is fractionated into a portion boiling below about 1000° F. (538° C.) and a fraction boiling above about 1000° F. (538° C.). The lower boiling fraction is hydrocracked in a first hydrocracking zone in a reactor. The effluent from the first hydrocracking zone is combined with the heavier boiling fraction and hydrocracked in a second hydrocracking zone in the reactor. The resulting liquid product is then fractionated to form a 150N basestock, a 350N basestock, and a 1800N bright stock.

U.S. Pat. No. 6,884,339 describes a method for processing a feed to produce a lubricant base oil and optionally distillate products. A feed is hydrotreated and then hydrocracked without intermediate separation. An example of the catalyst for hydrocracking can be a supported Y or beta zeolite. The catalyst also includes a hydro-dehydrogenating metal, such as a combination of Ni and Mo. The hydrotreated, hydrocracked effluent is then atmospherically distilled. The portion boiling above 340° C. is catalytically dewaxed in the presence of a bound molecular sieve that includes a hydro-dehydrogenating element. The molecular sieve can be ZSM-48, EU-2, EU-11, or ZBM-30. The hydro-dehydrogenating element can be a noble Group VIII metal, such as Pt or Pd.

U.S. Pat. No. 7,300,900 describes a catalyst and a method for using the catalyst to perform conversion on a hydrocarbon feed. The catalyst includes both a Y zeolite and a zeolite selected from ZBM-30, ZSM-48, EU-2, and EU-11. Examples are provided of a two stage process, with a first stage hydrotreatment of a feed to reduce the sulfur content of the feed to 15 wppm, followed by hydroprocessing using the catalyst containing the two zeolites. An option is also described where it appears that the effluent from a hydrotreatment stage is cascaded without separation to the dual-zeolite catalyst, but no example is provided of the sulfur level of the initial feed for such a process.

SUMMARY

In an embodiment, a method for producing a plurality of basestocks is provided. The method includes: contacting a feedstock containing at least about 90 wt % of hydrocarbons boiling above 370° C. with a first hydrocracking catalyst under first effective hydrocracking conditions to produce a first hydrocracked effluent, the first hydrocracked effluent having a sulfur content of less than about 250 wppm, the first effective hydrocracking conditions being effective for conversion of about 5 wt % to about 30 wt % of the feedstock to hydrocarbons boiling below 370° C.; fractionating the first hydrocracked effluent to form a first hydrocracked fraction and a second hydrocracked fraction; contacting the first hydrocracked fraction with a second hydrocracking catalyst under second effective hydrocracking conditions to produce a third hydrocracked fraction, the third hydrocracked fraction having a viscosity index of at least about 100, the second effective hydrocracking conditions being effective for conversion of about 15 wt % to about 40 wt % of the first hydrocracked fraction to hydrocarbons boiling below 370° C.; contacting the second hydrocracked fraction with a hydrocracking catalyst under third effective hydrocracking conditions to produce a fourth hydrocracked fraction, the fourth hydrocracked fraction having a viscosity index less than the viscosity index of the third hydrocracked fraction, the third effective hydrocracking conditions being effective for conversion of about 5 wt % to about 15 wt % of the second hydrocracked fraction to hydrocarbons boiling below 370° C.; dewaxing the third hydrocracked fraction and the fourth hydrocracked fraction under effective catalytic dewaxing conditions in the presence of a dewaxing catalyst; and fractionating the third dewaxed hydrocracked fraction and the fourth dewaxed hydrocracked fraction to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

In another embodiment, a method for producing a plurality of basestocks is provided. The method includes fractionating a feedstock containing at least about 90 wt % of hydrocarbons boiling above 370° C. to form a first fraction having a viscosity of less than 7 cSt at 100° C. and a second fraction; contacting the first fraction with an initial portion of a first hydrocracking catalyst under first effective hydrocracking conditions in a first reaction stage to produce a partially hydrocracked first fraction, the first hydrocracking catalyst comprising the initial portion and a remaining portion; introducing the second fraction into the first reaction stage at a location downstream from the initial portion of the first hydrocracking catalyst; contacting the partially hydrocracked first fraction and the second fraction with the remaining portion of the first hydrocracking catalyst under first effective hydrocracking conditions in the first reaction stage to produce a hydrocracked effluent, the hydrocracked effluent having a sulfur content of less than about 250 wppm, the first effective hydrocracking conditions being effective for conversion of about 5 wt % to about 30 wt % of the feedstock to hydrocarbons boiling below 370° C.; dewaxing the hydrocracked effluent under effective catalytic dewaxing conditions in the presence of a dewaxing catalyst; and fractionating the dewaxed hydrocracked effluent to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

In yet another embodiment, a method for producing a plurality of basestocks is provided. The method includes contacting a feedstock containing at least about 90 wt % of hydrocarbons boiling above 370° C. with a first hydrocracking catalyst under first effective hydrocracking conditions to produce a first hydrocracked effluent, the first hydrocracked effluent having a sulfur content of less than about 250 wppm, the first effective hydrocracking conditions being effective for conversion of about 5 wt % to about 30 wt % of the feedstock to hydrocarbons boiling below 370° C.; fractionating the first hydrocracked effluent to form a first hydrocracked fraction and a second hydrocracked fraction; dewaxing the first hydrocracked fraction and the second hydrocracked fraction under effective catalytic dewaxing conditions in the presence of a dewaxing catalyst; contacting the first dewaxed hydrocracked fraction with a second hydrocracking catalyst under second effective hydrocracking conditions to produce a third dewaxed hydrocracked fraction, the third dewaxed hydrocracked fraction having a viscosity index of at least about 100, the second effective hydrocracking conditions being effective for conversion of about 15 wt % to about 40 wt % of the first dewaxed hydrocracked fraction to hydrocarbons boiling below 370° C.; contacting the second dewaxed hydrocracked fraction with a third hydrocracking catalyst under third effective hydrocracking conditions to produce a fourth dewaxed hydrocracked fraction, the fourth dewaxed hydrocracked fraction having a viscosity index less than the viscosity index of the third dewaxed hydrocracked fraction, the third effective hydrocracking conditions being effective for conversion of about 5 wt % to about 15 wt % of the second dewaxed hydrocracked fraction to hydrocarbons boiling below 370° C.; and fractionating the third dewaxed hydrocracked fraction and the fourth dewaxed hydrocracked fraction to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

DETAILED DESCRIPTION

Figure 1:
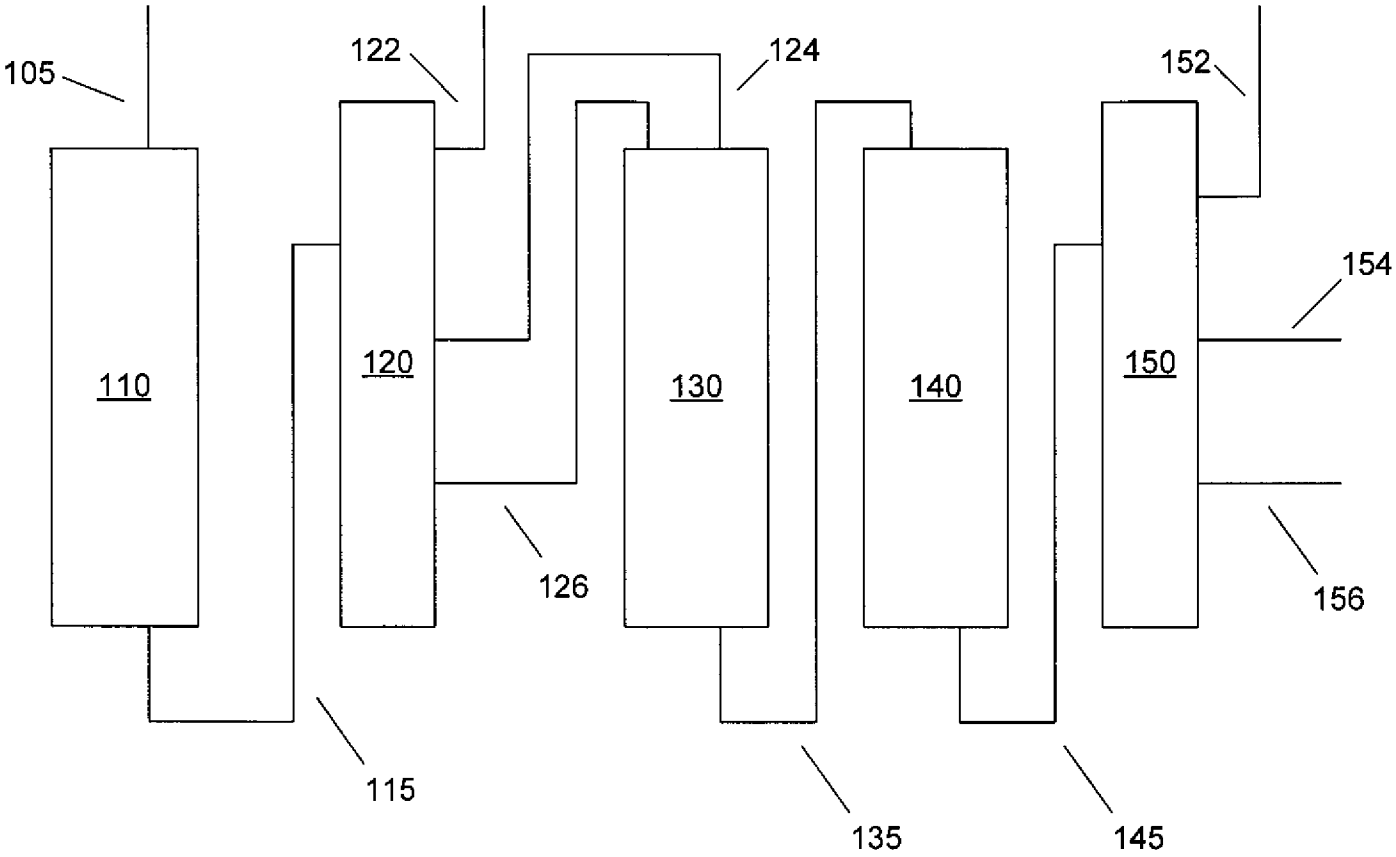
FIG. 1 schematically shows an example of a multi-stage reaction system according to an embodiment of the invention.

All numerical values within the detailed description and the claims herein are modified by "about" or "approximately" the indicated value, and take into account experimental error and variations that would be expected by a person having ordinary skill in the art.

Overview

One potential use for heavier feedstocks, such as vacuum gas oil (VGO) feedstocks, is production of lubricating oil basestocks. When a feedstock is suitable for use in production of lubricating oil basestocks, it is typically preferred to increase or maximize the production of basestock relative to fuels, as lubricating oils are usually higher value products.

One difficulty in producing lubricating oil basestocks can be related to the wide range of molecules present in many VGO or other heavy feeds. A higher overall yield of basestock may be possible if a VGO feed is used to produce a variety of basestock types. For example, in order to improve overall yield, it may be desirable to produce both a lower viscosity basestock that is suitable for passenger vehicles and a higher viscosity basestock that is suitable for commercial vehicles. In this type of example, one basestock could be an about 100N to about 250N basestock with a viscosity between about 4 cSt to about 6 cSt at 100° C., while a second basestock could be an about 250N to about 600N basestock with a viscosity of about 8 cSt to about 12 cSt at 100° C.

While using a wide cut feed to produce a range of basestocks can provide some yield improvement, further improvements are possible. For example, a typical process for hydrocracking a feed to produce multiple basestocks will involve hydrocracking the full feed to meet the viscosity index (VI) requirements for the desired basestocks. Unfortunately, hydrocracking a feed sufficiently to achieve a desired VI for a lighter viscosity lubricating oil basestock will typically lead to excess conversion of at least some portions of the feed. This can result in a lower overall basestock yield.

In various embodiments, systems and methods are provided for improving overall yield when producing multiple lubricating oil basestocks from a feed. In one option, an initial hydrocracking process can be used that is at a lower severity, so that after hydrocracking the hydrocracked feed does not yet meet viscosity and/or viscosity index requirements for the desired product slate of basestocks. Instead, the initial hydrocracking process can be used to remove sulfur and nitrogen contaminants from the feed. This typically requires less severe conditions, resulting in lower overall conversion of the feed into lighter products. After the initial hydrocracking, the hydrocracked feed is fractionated. This can allow for removal of portions of the feed that have been converted into lower boiling molecules that are more suitable for fuels, as well as light ends and other gas phase contaminants. The fractionation can also produce a plurality of potential basestock cuts. For example, a 150N and 500N fraction can be produced in the fractionator. The 150N (or other light fraction) and the 500N (or other heavy fraction) can then be hydrocracked under conditions effective for producing a desired amount of VI uplift for each fraction. For a 150N fraction, a typical use will be as a passenger vehicle lubricant. Passenger vehicle lubricants typically have more stringent VI requirements. A higher degree of feed conversion is typically required to achieve the desired VI. By contrast, the 500N fraction can be used for a commercial vehicle type lubricant, which often has a lower VI requirement. Fractionating the feed into two or more viscosity portions prior to performing VI uplift can allow the severity of the hydrocracking process to be targeted based on the desired end product. Additionally, performing the initial hydrocracking for sulfur and nitrogen removal prior to fractionation can allow the hydrocracking catalysts for VI uplift to be selected based on performance under "sweet" or low sulfur and nitrogen, conditions. One or more of these factors can lead to an improved total lubricating basestock yield from the initial feed.

Feedstocks

A mineral hydrocarbon feedstock refers to a hydrocarbon feedstock derived from crude oil that has optionally been subjected to one or more separation and/or other refining processes. A mineral hydrocarbon feedstock suitable for use in some embodiments of the invention can be a feedstock with an initial boiling point of at least about 650° F. (343° C.), or at least about 700° F. (371° C.), or at least about 750° F. (399° C.). Alternatively, the feedstock can be characterized by the boiling point required to boil a specified percentage of the feed. For example, the temperature required to boil at least 5 wt % of a feed is referred to as a "T5" boiling point. In an embodiment, the mineral hydrocarbon feedstock can have a T5 boiling point of at least about 700° F. (371° C.), or at least about 725° F. (385° C.). In another embodiment, the mineral hydrocarbon feed can have a T95 boiling point of about 1150° F. (621° C.) or less, or about 1100° F. (593° C.) or less, or about 1050° F. (566° C.) or less. Alternatively, the mineral hydrocarbon feed can have a final boiling point of about 1200° F. (649° C.) or less, or about 1150° F. (621° C.) or less, or about 1100° F. (593° C.) or less, or about 1050° F. (566° C.) or less. Examples of this type of feed can include gas oils, such as heavy gas oils or vacuum gas oils. The percentage of a feedstock that boils above 700° F. (370° C.) can be at least about 85%, or at least about 90%, or at least about 95%.

Mineral feedstreams can have a nitrogen content from about 50 to about 2000 wppm nitrogen, preferably about 50 to about 1500 wppm nitrogen, and more preferably about 75 to about 1000 wppm nitrogen. In an embodiment, feedstreams suitable for use herein can have a sulfur content from about 100 to about 50,000 wppm sulfur, preferably about 200 to about 30,000 wppm, and more preferably about 350 to about 10,000 wppm.

In addition to mineral oils, a feedstream can optionally include a portion corresponding to a biocomponent feedstock. In the discussion below, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

The content of sulfur, nitrogen, oxygen, and olefins (inter alia) in a feedstock created by blending two or more feedstocks can typically be determined using a weighted average based on the blended feeds. For example, a mineral feed and a biocomponent feed can be blended in a ratio of about 80 wt % mineral feed and about 20 wt % biocomponent feed. In such a scenario, if the mineral feed has a sulfur content of about 1000 wppm, and the biocomponent feed has a sulfur content of about 10 wppm, the resulting blended feed could be expected to have a sulfur content of about 802 wppm.

Reaction Products

In various embodiments, the inventive reaction system can be used to generate a plurality of basestocks. At least one basestock can be generated by fractionating the (processed) feed to meet a desired combination of viscosity and Noack volatility. Before or after the fractionation, the at least one basestock is hydrocracked to increase the viscosity index.

In an embodiment, one of the basestocks from the plurality of basestocks can have a viscosity at 100° C. of at least about 3.0 cSt, or at least about 3.75 cSt, or at least about 4.5 cSt, or at least about 4.75 cSt, or at least about 5.0 cSt. Additionally or alternately, the viscosity at 100° C. can be about 7.0 cSt or less, or about 6.5 cSt or less, or about 6.25 cSt or less, or about 6.0 cSt or less, or about 5.75 cSt or less, or about 5.5 cSt or less, or about 5.25 cSt or less. This can correspond to a light neutral basestock, such as a basestock with a Saybolt Universal Seconds (SUS) value at 100° C. of at least about 100N, or at least 150N, and/or the SUS value can be about 250N or less, or 200N or less. In another embodiment, one of the basestocks from the plurality of basestocks can have a viscosity at 100° C. of at least about 8.0 cSt, or at least about 8.5 cSt, or at least about 9.0 cSt, or at least about 9.5 cSt, or at least about 10.0 cSt. Additionally or alternately, the viscosity at 100° C. can be about 12.0 cSt or less, or about 11.5 cSt or less, or about 11.0 cSt or less, or about 10.5 cSt or less, or about 10.0 cSt or less. This can correspond to a basestock with a SUS value of at least about 250N, or at least about 300N, or at least about 350N, or at least about 400N, and/or the SUS value can be about 600N or less, or about 550N or less, or about 500N or less, or about 450N or less. With regard to Noack volatility, at least one basestock can be selected to have a Noack volatility of at least about 5, or at least about 8, or at least about 10. The Noack volatility can be about 20 or less, or about 15 or less, or about 10 or less.

Using a combination of viscosity and Noack volatility, cut points can be selected for fractionation to form the plurality of desired basestocks. For example, to form two basestocks, a first cut point can be selected to remove lighter molecules, while a second cut point can provide a boundary between the first and second basestocks. In this type of example, the first cut point can be used to limit the Noack volatility of the lighter basestock. In such an example, the second cut point can be used to select a viscosity for the lighter basestock in a desired range, such as between about 4.0 cSt to about 7.0 cSt. Optionally, a third cut point can also be used, to maintain a desired viscosity for the second basestock, such as a viscosity between about 8.0 cSt and about 12.0 cSt. These considerations can be used to set fractionation cut points during one or more fractionations within a process flow.

Fractionation can allow for control of the viscosity and/or volatility characteristics of desired basestock products. The viscosity index of one or more basestock products can also be selected, such as by controlling the severity of hydrocracking. The severity of a hydrocracking process is typically described based on an amount of conversion that occurs during hydrocracking. In this discussion, the amount of conversion for a hydrocracking process refers to conversion of molecules boiling above 370° C. to molecules boiling below 370° C.

In some embodiments, an initial hydrocracking stage can be used to reduce the sulfur and/or nitrogen content of a feedstock. For a hydrocracking stage for desulfurization or denitrogenation, the amount of conversion in the stage can be at least about 5%, or at least about 10%, or at least about 15%.

Additionally or alternately, the amount of conversion in such a hydrocracking stage can be about 30% or less, or about 25% or less, or about 20% or less.

In a second hydrocracking stage, the amount of conversion can be selected based on a desired amount of viscosity index (VI) uplift. A second hydrocracking stage can occur after fractionation of effluent from the first hydrocracking stage, so that separate hydrocracking conditions are selected for each desired basestock. To form a general Group II basestock, the desired VI may be at least about 80, or at least about 90, or at least about 100. After an initial hydrodesulfurization stage, the amount of additional hydrocracking to achieve a desired VI can correspond to conversion of about 5% or less, or about 10% or less, or about 15% or less. For other basestocks, the second hydrocracking stage can be operated to generate sufficient VI uplift to achieve a VI of at least about 105, or at least about 110, or at least about 115, or at least about 120, or at least about 125. This amount of VI uplift can correspond to conversion of at least about 15%, or at least about 20%, or at least about 25%. Because some VI uplift has already occurred in a first hydrocracking stage, the amount of hydrocracking in the second stage can be less than about 40%, or less than about 35%, or less than about 30%.

In an alternative configuration, a single hydrocracking stage can be used with fractionation of the feed into a plurality of portions prior to hydrocracking. In this type of embodiment, a first portion of feed can be exposed to all of the catalyst in the stage, while one or more additional portions of a feed can be introduced at a downstream location in the single hydrocracking stage. In this type of embodiment, the total conversion for the feed can be about 50% or less, or about 45% or less, or about 40% or less, or about 35% or less, or about 30% or less. An additional portion of feed can be introduced at a downstream location so that the additional portion of feed is exposed to 75% or less of the catalyst in the stage, or 50% or less, or 30% or less.

Process Flow Schemes

In the discussion below, a stage can correspond to bed within a reactor, a single reactor, or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds, and optionally as separate stages.

In a traditional process, the goal of a hydrocracking stage would be to perform sufficient conversion of the feed to meet viscosity index requirements for each desired basestock. Typically, this means performing sufficient conversion to achieve the viscosity index requirement for the lightest viscosity basestock. However, this also results in viscosity index upgrading of the higher viscosity basestocks, even though the higher viscosity index is not required to meet typical commercial vehicle lubricating oil specifications. The desired amount of viscosity index uplift is typically from about 50 to about 70. This typically requires conversion of about 30% to about 70% of the feed from above 370° C. to below about 370° C. Due to the large amount of conversion, a substantial portion of the initial feed can be converted either to a fuel or a light ends type product.

In a first configuration, a feedstock containing molecules suitable for multiple types of lubricating oil basestocks is hydrocracked to remove contaminants from the feed, such as sulfur and nitrogen. The hydrocracked feed can then be fractionated to form portions that roughly correspond to the desired lubricating oil basestocks. The separate fractions can then be hydrocracked a second time. The second hydrocracking process can be tailored to match the desired properties for each fraction. After the second hydrocracking, each fraction can be dewaxed to improve cold flow properties. A final fractionation can then be used to separate any additional lower boiling range molecules from the desired basestocks.

FIG. 1*a* shows an example of a reaction system according to the first configuration. In FIG. 1, a vacuum gas oil feed 105 or other feed with a suitable boiling range is introduced into a hydrocracking stage 110. The hydrocracking stage 110 allows the feed 105 to be exposed to a hydrocracking catalyst under effective hydrocracking conditions. The effective hydrocracking conditions are selected for desulfurization and/or denitrogenation of the feed. After hydrocracking, the hydrocracked feed can have a sulfur content of about 250 wppm or less, or about 100 wppm or less, or about 50 wppm or less, or about 20 wppm or less. The amount of conversion to below 370° C. is from about 5% to about 30%, and preferably from about 5% to about 20%. Due to the lower amount of conversion, the amount of product loss due to conversion into fuels or light ends is reduced relative to a traditional configuration. The amount of VI uplift during the hydrocracking for nitrogen or sulfur removal can be about 50 or less. The amount of VI uplift can be at least about 20, or at least about 25, or at least about 30. Additionally or alternately, the amount of VI uplift can be about 50 or less, or about 45 or less, or about 40 or less.

Optionally, first hydrocracking stage 110 can include one or more beds or partial beds of hydrotreating catalyst, in addition to the hydrocracking catalyst. The one or more beds of hydrotreating catalyst can further assist in removing sulfur and/or nitrogen from a feedstock. The beds of hydrotreating catalyst can be at any convenient location within hydrocracking stage 110, such as at the beginning of the stage 110.

After hydrocracking, hydrocracked feed 115 can be fractionated 120 to separate out the desired fractions from lower boiling products. The fractionation 120 can be performed using any suitable method, such as vacuum distillation. The cut points for the fractionation are typically determined based on the desired volatility and viscosity characteristics of the desired lubricating oil basestocks. In an example where two basestocks are desired, the first fraction 124 can correspond to a fraction suitable for forming a passenger lubricating oil basestock while a second fraction 126 can correspond to a fraction suitable for forming a commercial vehicle lubricating oil basestock. The cut point for fractionation can be selected to provide a first fraction 124 with a viscosity, for example, of about 4.7 cSt and a Noack volatility of 15. This can correspond to a light neutral basestock, such as a 150N basestock. The second fraction 126 can correspond to a heavier basestock with a higher viscosity, such as a 500N basestock with a viscosity of 10.5 cSt. The fractionation 120 also allows for removal of lower boiling products 122. Optionally, an additional cut point in the fractionation 120 can allow for formation of a bottoms fraction (not shown). If the feedstock contains heavier molecules that are not suitable for use in a lubricating oil even after hydrocracking, such heavier molecules can be separated out. These heavier molecules can be recycled for additional hydrocracking, to attempt to incorporate the molecules into a lubricant basestock. Alternatively, these heavier molecules can be diverted to another process train.

After fractionation 120, the fractions are hydrocracked a second time in separate processes. Because of the first hydrocracking 110, the hydrocracked fractions have a reduced sulfur content. As a result, the second hydrocracking stage can correspond to a "sweet" hydrocracking stage. The second hydrocracking stage can be operated under effective conditions for processing each of the desired product fractions. For a lighter viscosity passenger lubricant basestock, the hydrocracking can be more severe to provide a desired amount of viscosity index uplift. For a higher viscosity basestock, such as a basestock for a commercial lubricant, less uplift may be needed and therefore less severe hydrocracking conditions can be used.

The separate processing for each fraction can be provided in any convenient manner. In the embodiment shown in FIG. 1, a single second hydrocracking stage 130 can be used for hydrocracking the fractions 124 and 126. In such an embodiment, tanks can be used to store fractions 124 and 126 generated by fractionator 120. At any given time, one fraction can be passed into second hydrocracking stage 130 for processing. The resulting effluents (or fractions of effluents) 135 from performing the second hydrocracking 130 on fractions 124 and 126 can then be processed in the remaining portions of the reaction system. A fraction 124 or 126 passed into second hydrocracking stage 130 can be delivered from tank storage, or at least a portion of the fraction can be passed into second hydrocracking stage 130 directly from fractionator 120. In an alternative embodiment, second hydrocracking stage 130 can represent multiple hydrocracking stages that are operated independently, each generating a separate effluent or effluent fraction 135. In such an alternative embodiment, each fraction, such as fractions 124 and 126, can be processed in a second hydrocracking stage 130 with conditions effective for the hydrocracking of the particular fraction.

The effluent(s) 135 from second hydrocracking stage 130 can then be dewaxed in a catalytic dewaxing stage 140. Catalytic dewaxing stage 140 can provide improvement in cold flow properties for the effluent(s) 135 generated in second hydrocracking stage 130. Preferably, the catalysts and effective dewaxing conditions in catalytic dewaxing stage 140 are selected to provide dewaxing by isomerization in preference to cracking. The dewaxed, hydrocracked effluent 145 can then be fractionated 150 a second time to generate the desired lubricant oil basestocks 154 and 156, as well as a light ends and/or fuel fraction 152.

It is noted that the second hydrocracking stage 130 and the catalytic dewaxing stage 140 will often correspond to stages operated under "sweet" conditions. If the first hydrocracking stage 110 is operated under conditions to reduce the sulfur and nitrogen content, the sulfur content and the nitrogen content of the feed can be sufficiently low to have a low or minimal impact on the reactivity of the catalyst in the second hydrocracking stage 130 or the catalytic dewaxing stage 140. Any gas phase sulfur and nitrogen species are removed by fractionation 120. In this situation, the amount of hydrocracking catalyst required for second hydrocracking stage 130 may require less than a full reactor. As an alternative, the second hydrocracking stage 130 can be one or more catalyst beds of hydrocracking catalyst located in the same reactor as catalytic dewaxing stage 140.

Figure 6:
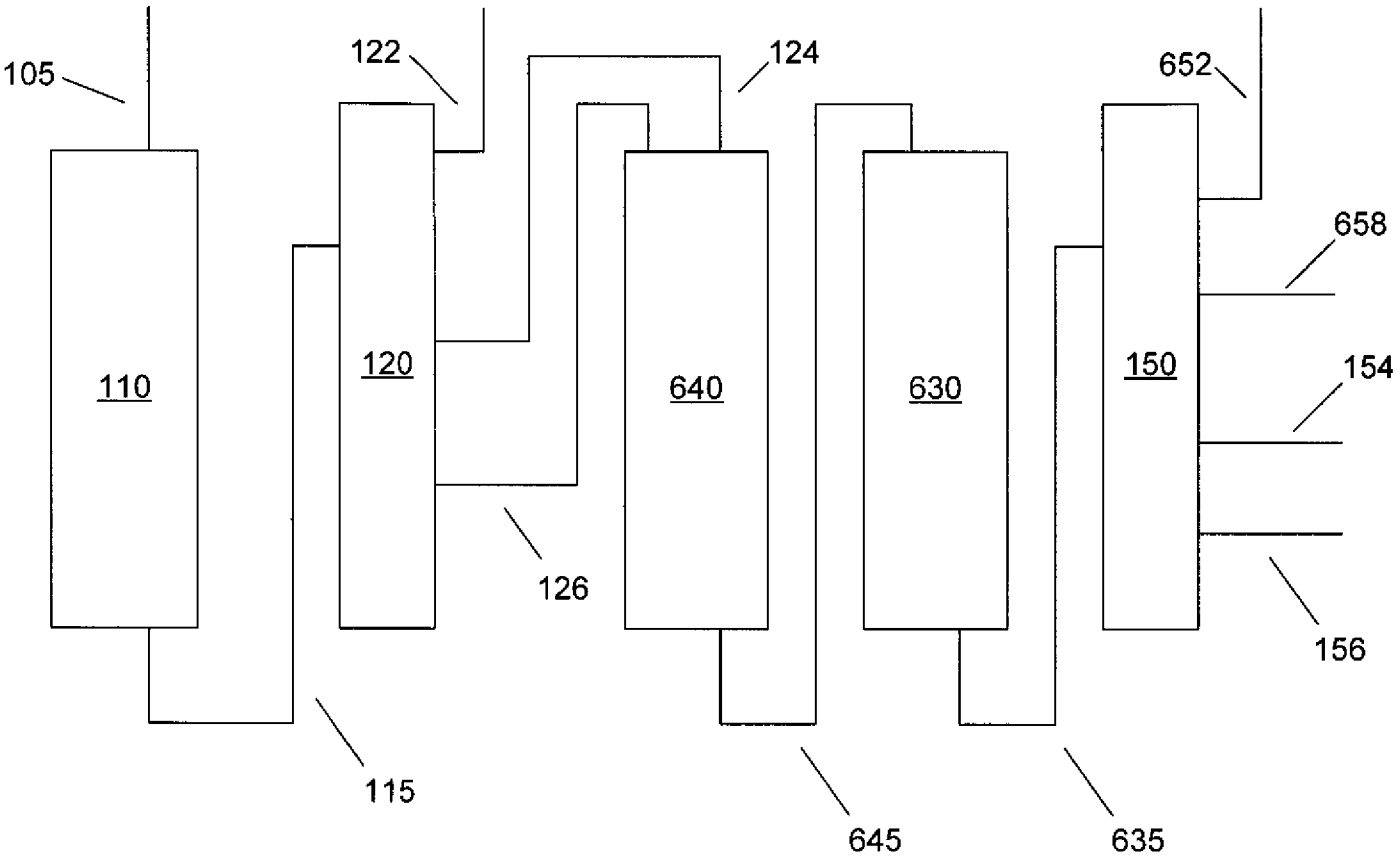
FIG. 6 schematically shows an example of a multi-stage reaction system according to an alternative embodiment of the invention.

In an alternative embodiment, it may be desirable to improve the diesel yield from a feedstock while still also producing a desired slate of lubricant oil basestocks. In this alternative, a dewaxing stage can be used prior to the second hydrocracking stage. FIG. 6 shows an example of this type of alternative. The configuration in FIG. 6 includes many of the same features as the configuration in FIG. 1. However, the dewaxing stage 640 in FIG. 6 occurs prior to second hydrocracking stage 630. In FIG. 6, the outputs 124 and 126 from the fractionator are passed into dewaxing stage 640. The dewaxed effluent 645 is then passed into second hydrocracking stage 630, which performs the additional conversion needed to meet desired lubricant oil basestock specifications. The effluent 635 from second hydrocracking stage 630 is then passed into fractionator 150, for formation of lubricant oil basestocks 154 and 156 as described above. In FIG. 6, a diesel fraction 658 is also shown. This diesel fraction represents a fraction that was included as part of the general fuels and light ends fraction 152 in FIG. 1. In FIG. 6, diesel fraction 658 is shown separately from the fraction 652 corresponding to the other fuels and light ends. FIG. 6 represents one example of exchanging the positions of the dewaxing stage and the second hydrocracking stage. Those of skill in the art will recognize that this exchange of the positions of the dewaxing and second hydrocracking stages can generally be used with various embodiments of the invention.

Figure 2:
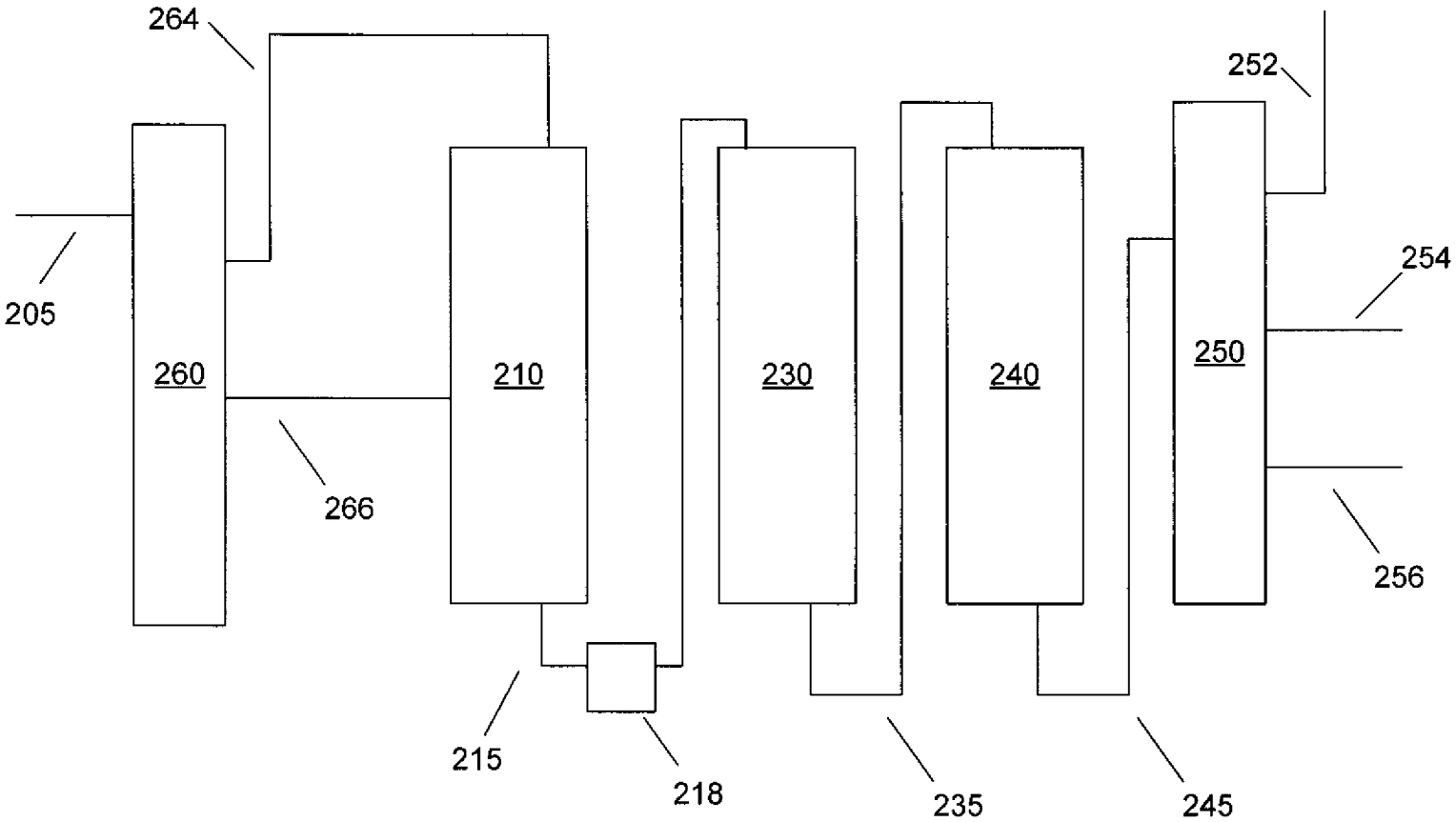
FIG. 2 schematically shows an example of an alternative reaction system according to an embodiment of the invention.

FIG. 2 shows a configuration according to an alternative embodiment of the invention. In FIG. 2, a single process train is provided for hydrocracking of a wide cut feedstock for lubricant oil basestock production. In the embodiment shown in FIG. 2, an initial fractionation 260 is performed on a vacuum gas oil feedstock 205 (or other feed having a suitable boiling range) prior to passing the feedstock 205 into the first hydrocracking stage 210. The initial fractionation 260 is used to form a plurality of feed fractions. The feed fractions are selected based on the viscosity and volatility relationships for the desired product basestocks. Thus, a light vacuum gas oil first fraction 264 (possibly corresponding to a light vacuum gas oil fraction) can be formed based on a desired passenger vehicle basestock specification for viscosity and volatility, while a second fraction 266 (possibly a bottoms fraction or a heavy vacuum gas oil fraction) corresponds to a higher viscosity feed for a commercial vehicle basestock. After initial fractionation 260, the first fraction 264 is passed into the first hydrocracking stage 210. As shown in FIG. 2, the first fraction 264 can be exposed to all of the catalyst or catalyst beds present in first hydrocracking stage 210. This allows first fraction 264 to be hydrocracked to achieve a desired amount of conversion and/or viscosity index uplift for this fraction. The second fraction 266 is passed into first hydrocracking stage 260 at a point in the reactor downstream from at least a portion of the hydrocracking catalyst in the reactor. Introducing the second fraction 266 into first hydrocracking stage 210 at a downstream location reduces the amount of conversion and/or viscosity index uplift for the second fraction. In some embodiments, second fraction 266 is introduced into first hydrocracking stage 210 at a location suitable for removing sulfur and nitrogen contaminants from second fraction 266 while reducing or minimizing the amount of conversion and/or viscosity index uplift for the second fraction. Optionally, one or more beds of hydrotreating catalyst can also be included at any convenient location within hydrocracking stage 210.

The hydrocracked effluent 215 from hydrocracking stage 210 can optionally be fractionated (not shown) or optionally separated in a separator 218. Use of a separator 218 or a fractionator allows for removal of low boiling components of the hydrocracked effluent, including any gas phase sulfur and nitrogen contaminants produced in the first hydrocracking stage. Removal of the sulfur and nitrogen contaminants can allow subsequent stages to operate under low sulfur and/or nitrogen (or "sweet") conditions. Because the first fraction 264 and second fraction 266 have already been hydrocracked for different amounts of time, a fractionation may not be necessary after the first hydrocracking stage 210. A second hydrocracking stage 230 can also be optionally used to further hydrocrack the effluent 215 from first hydrocracking stage 210 or an optional fractionator. After optionally passing through a fractionator and/or second hydrocracking stage 230, the resulting effluent 235 is catalytically dewaxed 240 to improve cold flow properties for the basestocks. The dewaxing effluent 245 can then be fractionated 250 to form the desired basestock fractions 254 and 256, as well as a light ends and/or fuels fraction 252.

Figure 7:
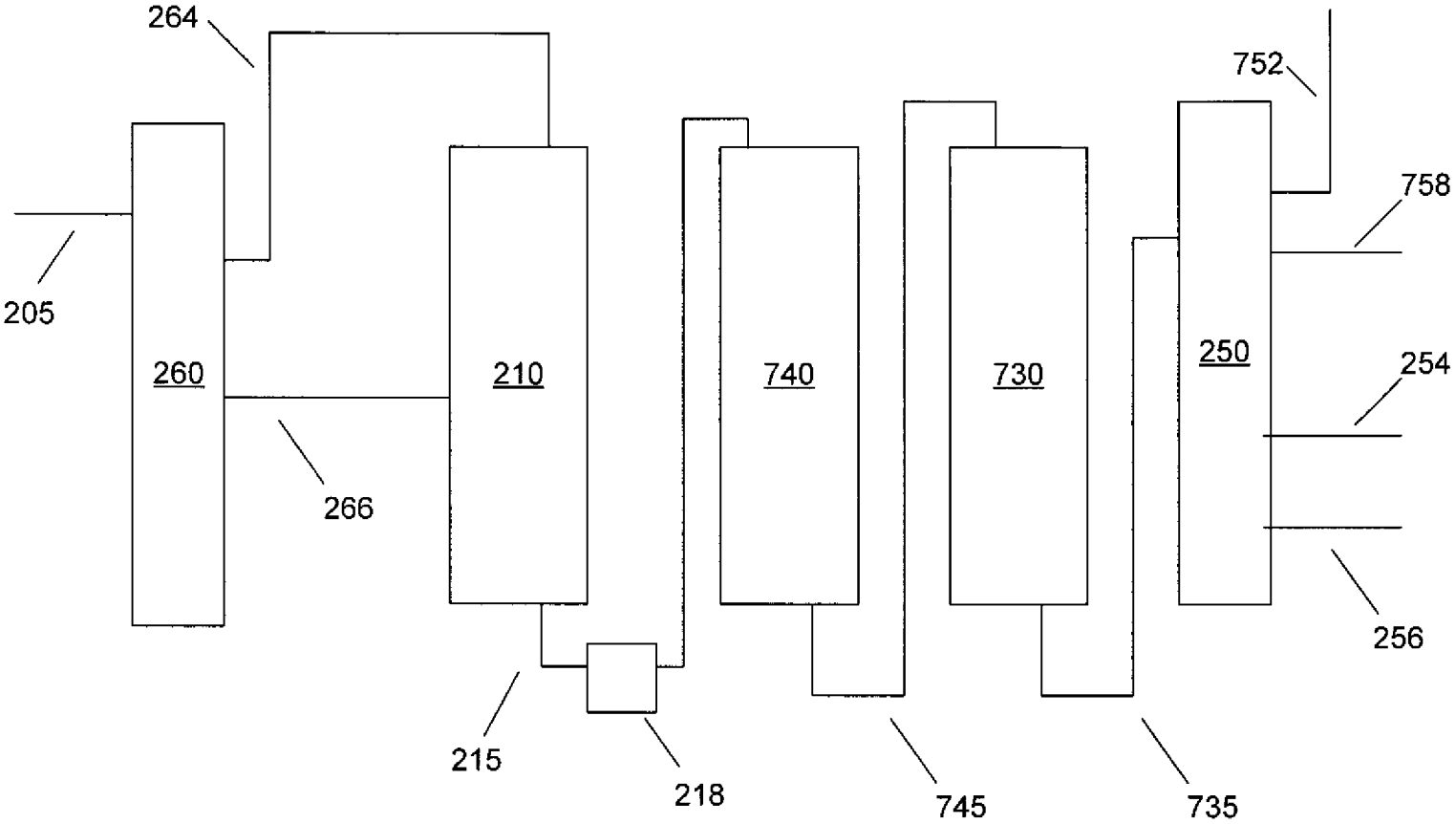
FIG. 7 schematically shows an example of an alternative reaction system according to an alternative embodiment of the invention.

As noted above, the dewaxing stage and second hydrocracking stage in various embodiments of the invention can be exchanged. FIG. 7 provides another example of this exchange. The configuration in FIG. 7 shares many of the features of the configuration in FIG. 2. However, the position of dewaxing stage 740 and second hydrocracking stage 730 is exchanged in FIG. 7. As a result, the output of separator 218 is passed into dewaxing stage 740. The dewaxed effluent 745 is then introduced into second hydrocracking stage 730. The effluent 735 from the second hydrocracking stage is then fractionated in fractionator 250 into desired lubricant oil basestocks 254 and 256. In FIG. 7, a diesel fraction 758 is also shown. This diesel fraction represents a fraction that was included as part of the general fuels and light ends fraction 252 in FIG. 2. In FIG. 7, diesel fraction 758 is shown separately from the fraction 752 corresponding to the other fuels and light ends.

Figure 3:
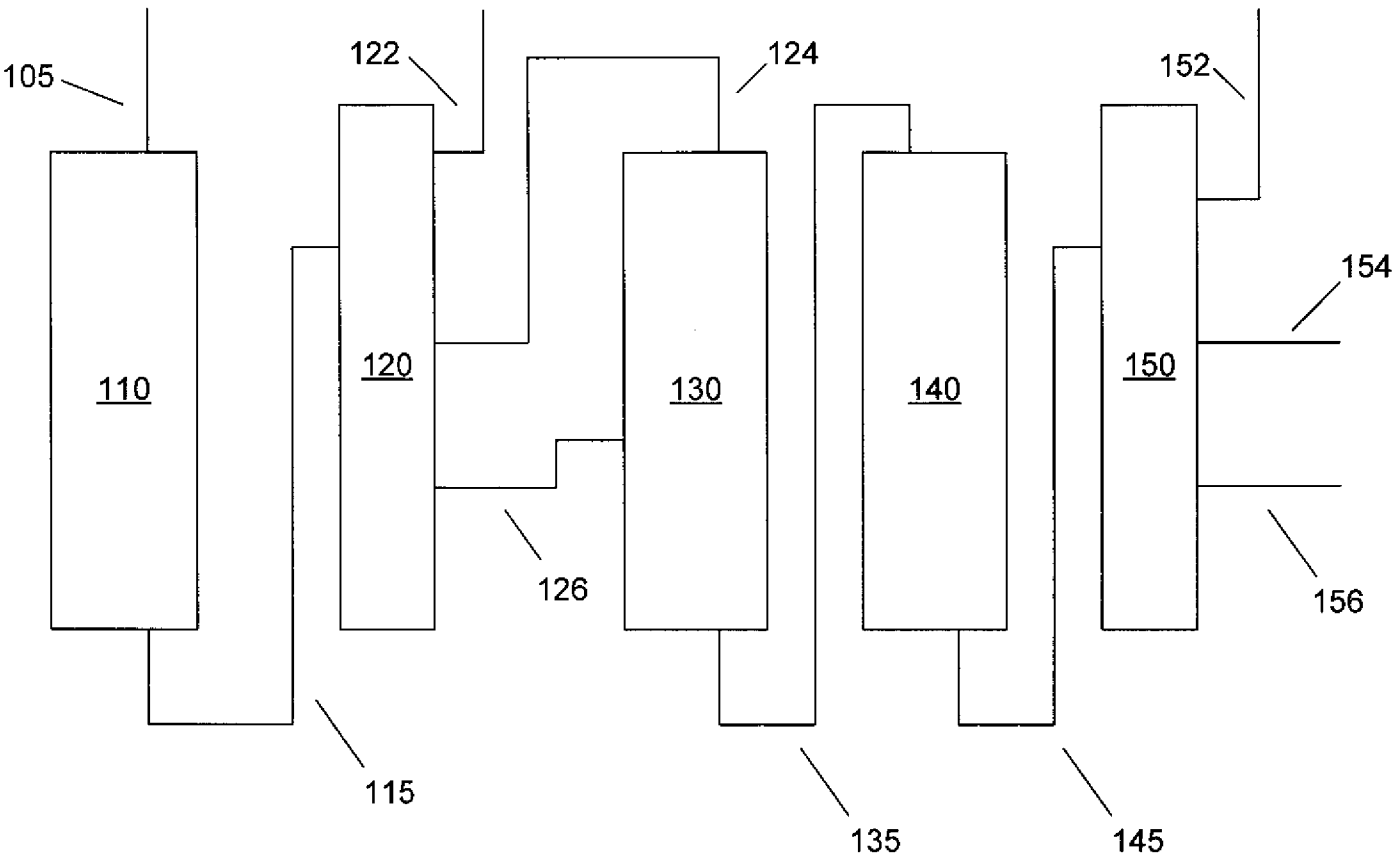
FIGS. 3 and 4 schematically show additional variations of reaction systems according to embodiments of the invention.

FIG. 3 depicts a variation on the configuration shown in FIG. 1. In FIG. 3, second or heavier fraction 126 is not passed into the top of hydrocracking stage 130. Instead, the fraction 126 is introduced at an intermediate point in the reactor. Optionally, this type of configuration can be used to allow both lighter fraction 124 and heavier fraction 126 to be hydrocracked at the same time, such as in the manner described for the embodiment in FIG. 2.

Figure 4:
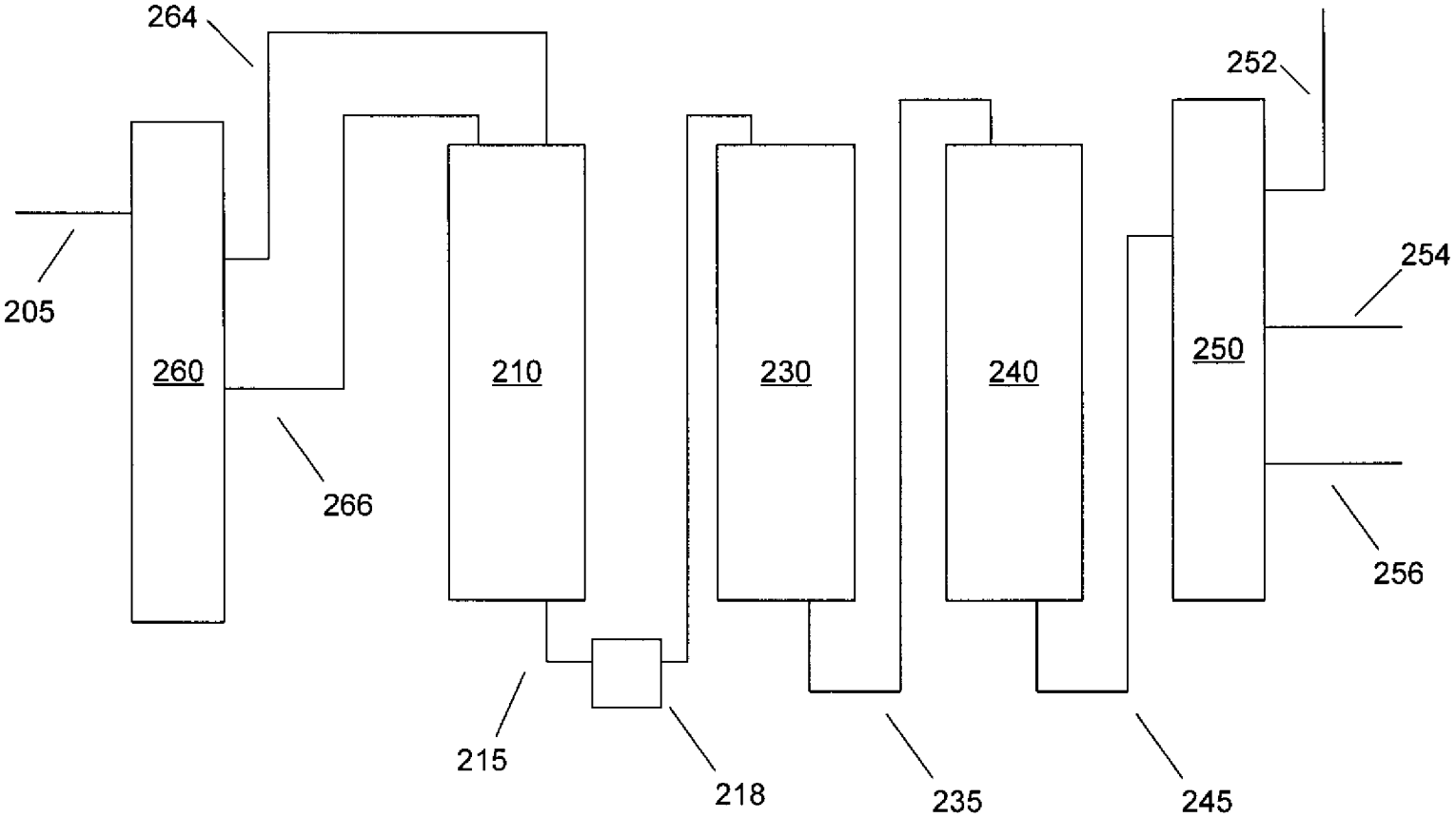

FIG. 4 depicts a variation on the configuration shown in FIG. 2. In FIG. 4, second or heavier fraction 266 is passed into the top of first hydrocracking stage 210. This can allow first hydrocracking stage 210 to be operated in a block manner, with a higher reaction temperature (or other increased severity conditions) used for processing of fraction 264 and a lower reaction temperature (or other decreased severity conditions) used for processing of fraction 266. In this type of embodiment, tank storage can be used to hold fractions 264 and 266 when not being processed, or multiple reactors 210 can be used to process fractions 264 and 266 in parallel under reaction conditions suitable for each feedstock.

Catalysts and Reaction Conditions

Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Non-limiting examples of metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. A hydrocracking catalyst including a noble metal may provide better selectivity for a hydrocracking stage operated under "sweet" or low sulfur/nitrogen conditions. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

Examples of suitable catalysts for a first reaction stage include catalysts suitable for use in a sour operating environment. Such catalysts can include catalysts with supported Group VI and non-noble Group VIII metals. Examples can include catalysts supporting NiW, NiMo, or CoMo. The supported metals will typically be sulfided. The support can be any suitable support with sufficient acidity for the desired hydrocracking process, such as refractory oxide supports or supports including one or more zeolites.

In a second reaction stage, which has reduced levels of sulfiur and/or nitrogen contaminants, the catalysts suitable for use in a first reaction stage can also be used. Additionally, other types of catalysts may also be suitable. Some examples can include catalysts with supported Group VI and non-noble Group VIII metals, but with a reduced acidity relative to the catalyst used in the first stage. The lower levels of sulfur and/or nitrogen contaminants can allow for effective use of lower acidity catalysts in the second stage. Additionally, catalysts with supported Group VIII noble metals can also be used. This can include catalysts with supported Pt, Pd, Rh, Ir, or a combination thereof. In many situations, the noble metals supported on a hydrocracking catalyst will not be sulfided.

A hydrocracking process in the first stage (or otherwise under sour conditions) can be carried out at temperatures of about 200° C. to about 450° C., hydrogen partial pressures of from about 250 psig to about 5000 psig (1.8 MPa to 34.6 MPa), liquid hourly space velocities of from about 0.2 $h^{-1}$ to about 10 $h^{-1}$, and hydrogen treat gas rates of from about 35.6 $m^3/m^3$ to about 1781 $m^3/m^3$ (200 SCF/B to 10,000 SCF/B). Typically, in most cases, the conditions will have temperatures in the range of 300° C. to 450° C., hydrogen partial pressures of from about 500 psig to about 2000 psig (3.5 MPa-13.9 MPa), liquid hourly space velocities of from about 0.3 $h^{-1}$ to about 2 $h^{-1}$ and hydrogen treat gas rates of from about 213 $m^3/m^3$ to about 1068 $m^3/m^3$ (1200 SCF/B to 6000 SCF/B).

A hydrocracking process in a second stage (or otherwise under non-sour conditions) can be performed under conditions similar to those used for a first stage hydrocracking process, or the conditions can be different. In an embodiment, the conditions in a second stage can have less severe conditions than a hydrocracking process in a first (sour) stage. The temperature in the hydrocracking process can be 20° C. less than the temperature for a hydrocracking process in the first stage, or 30° C. less, or 40° C. less. The pressure for a hydrocracking process in a second stage can be 100 psig (690 kPa) less than a hydrocracking process in the first stage, or 200 psig (1380 kPa) less, or 300 psig (2070 kPa) less.

In various embodiments, a feed can also be hydrotreated in the first stage prior to further processing. A suitable catalyst for hydrotreatment can comprise, consist essentially of, or be a catalyst composed of one or more Group VIII and/or Group VIB metals on a support such as a metal oxide support. Suitable metal oxide supports can include relatively low acidic oxides such as silica, alumina, silica-aluminas, titania, or a combination thereof. The supported Group VIII and/or Group VIB metal(s) can include, but are not limited to, Co, Ni, Fe, Mo, W, Pt, Pd, Rh, Ir, and combinations thereof. Individual hydrogenation metal embodiments can include, but are not limited to, Pt only, Pd only, or Ni only, while mixed hydrogenation metal embodiments can include, but are not limited to, Pt and Pd, Pt and Rh, Ni and W, Ni and Mo, Ni and Mo and W, Co and Mo, Co and Ni and Mo, Co and Ni and W, or another combination.

For either a hydrocracking or hydrotreating catalyst, when only one (hydrogenation) metal is present, the amount of that metal can be at least about 0.1 wt % based on the total weight of the catalyst, for example at least about 0.5 wt % or at least about 0.6 wt %. Additionally or alternately when only one metal is present, the amount of that metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one metal is present, the collective amount of metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one metal is present, the collective amount of metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. The amounts of metal(s) may be measured by methods specified by ASTM for individual metals, including but not limited to atomic absorption spectroscopy (AAS), inductively coupled plasma-atomic emission spectrometry (ICP-AAS), or the like. The hydrotreatment conditions can correspond to the hydrocracking conditions for the first stage.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

One characteristic that can impact the dewaxing activity of the molecular sieve is the ratio of silica to alumina ($Si/Al_2$ ratio) in the molecular sieve. In an embodiment, the molecular sieve can have a silica to alumina ratio of about 200:1 or less, for example about 150:1 or less, about 120:1 or less, about 100:1 or less, about 90:1 or less, or about 75:1 or less. Additionally or alternately, the molecular sieve can have a silica to alumina ratio of at least about 30:1, for example at least about 40:1, at least about 50:1, or at least about 65:1.

Aside from the molecular sieve(s) and optional binder, the dewaxing catalyst can also optionally but preferably include at least one metal hydrogenation component, such as a Group VIII metal. Suitable Group VIII metals can include, but are not limited to, Pt, Pd, Ni, or a combination thereof. When a metal hydrogenation component is present, the dewaxing catalyst can include at least about 0.1 wt % of the Group VIII metal, for example at least about 0.3 wt %, at least about 0.5 wt %, at least about 1.0 wt %, at least about 2.5 wt %, or at least about 5.0 wt %. Additionally or alternately, the dewaxing catalyst can include about 10 wt % or less of the Group VIII metal, for example about 5.0 wt % or less, about 2.5 wt % or less, about 1.5 wt % or less, or about 1.0 wt % or less.

In some embodiments, the dewaxing catalyst can include an additional Group VIB metal hydrogenation component, such as W and/or Mo. In such embodiments, when a Group VIB metal is present, the dewaxing catalyst can include at least about 0.5 wt % of the Group VIB metal, for example at least about 1.0 wt %, at least about 2.5 wt %, or at least about 5.0 wt %. Additionally or alternately in such embodiments, the dewaxing catalyst can include about 20 wt % or less of the Group VIB metal, for example about 15 wt % or less, about 10 wt % or less, about 5.0 wt % or less, about 2.5 wt % or less, or about 1.0 wt % or less. In one preferred embodiment, the dewaxing catalyst can include Pt and/or Pd as the hydrogenation metal component. In another preferred embodiment, the dewaxing catalyst can include as the hydrogenation metal components Ni and W, Ni and Mo, or Ni and a combination of W and Mo.

In various embodiments, the dewaxing catalyst used according to the invention can advantageously be tolerant of the presence of sulfur and/or nitrogen during processing. Suitable catalysts can include those based on zeolites ZSM-48 and/or ZSM-23 and/or zeolite Beta. It is also noted that ZSM-23 with a silica to alumina ratio between about 20:1 and about 40:1 is sometimes referred to as SSZ-32. Additional or alternate suitable catalyst bases can include 1-dimensional 10-member ring zeolites. Further additional or alternate suitable catalysts can include EU-2, EU-11, and/or ZBM-30.

Process conditions in a catalytic dewaxing zone in a sour environment can include a temperature of from 200 to 450° C., preferably 270 to 400° C., a hydrogen partial pressure of from 1.8 to 34.6 mPa (250 to 5000 psi), preferably 4.8 to 20.8 mPa, a liquid hourly space velocity of from 0.2 to 10 v/v/hr, preferably 0.5 to 3.0, and a hydrogen circulation rate of from 35.6 to 1781 $m^3/m^3$ (200 to 10,000 scf/B), preferably 178 to 890.6 $m^3/m^3$ (1000 to 5000 scf/B).

PROCESS EXAMPLES

The following process example is based on modeling of reactions within two reactor configurations. The first reactor configuration corresponds to the configuration shown in FIG. 1. The second reactor configuration corresponds to the comparative configuration shown in FIG. 5. In the comparative configuration in FIG. 5, a feedstock 505 is passed into a hydrocracking stage 510. The effluent 515 from hydrocracking stage 510 is then catalytically dewaxed 540. The hydrocracked, dewaxed effluent 545 is then fractionated 550 to form desired lubricant basestocks 554 and 556 and separate out lower boiling components 552.

In the model reactions, the same model feedstock was used in both configurations. The model feedstock corresponded to a wide cut vacuum gas oil, including components suitable for making both passenger and commercial grade lubricant basestocks. The same model hydrocracking catalyst was also used in all of the hydrocracking stages for both the first configuration and the second configuration. However, the model reaction temperature was higher in the hydrocracking stage of the second configuration, in order to increase the amount of conversion and viscosity index uplift. In the first configuration, the temperature and other severity conditions in the first and second stages were set independently, as described further below. The dewaxing catalyst for both of the dewaxing stages was also the same. For the first configuration, the basestock fractions entering the second hydrocracking stage were modeled as if they were processed in parallel reactors, so that the reaction conditions for each fraction could be separately controlled. This allowed higher severity conditions for the lighter fraction in the first configuration, in order to meet target viscosity index values.

In the model configurations, the output goal was to create two lubricant basestocks. The first target lubricant basestock was a 150N basestock having a 4.7 cSt viscosity at 100° C. and a Noack volatility of at least about 15. The target viscosity index for this basestock was about 110. The second target lubricant basestock was a 500N basestock having a viscosity of 10.5 cSt at 100° C. This heavier basestock is representative of a commercial vehicle lubricant basestock. Therefore, the process conditions were not modified to achieve a desired viscosity index value for this heavier basestock. Due to conversion in the hydrocracking unit(s) of the two configurations, a portion of fuels and light ends was also generated during processing.

Figure 5:
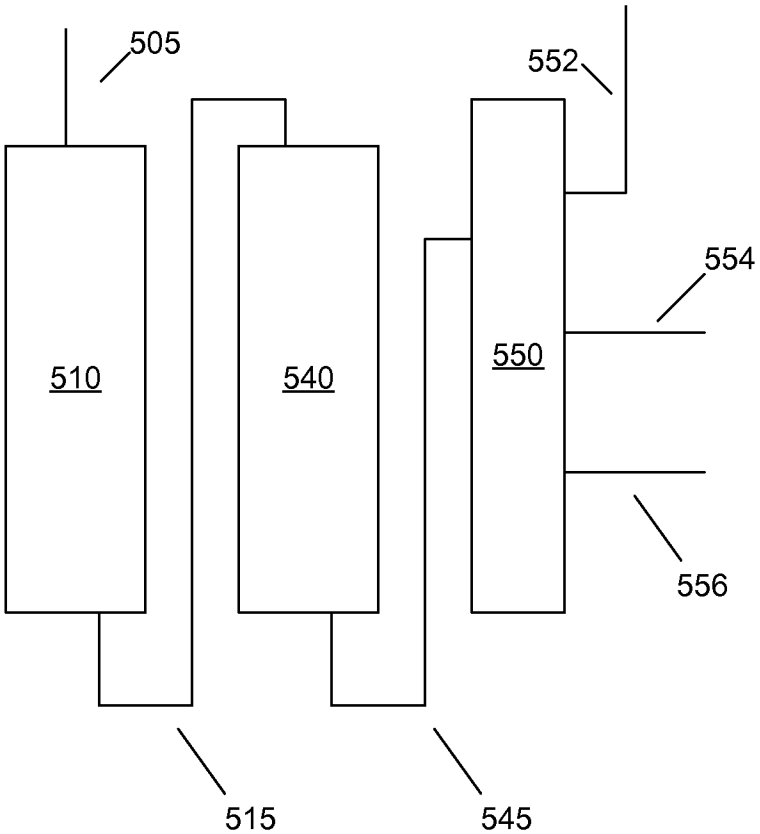
FIG. 5 Prior Art
FIG. 5 schematically shows a comparative reaction configuration.

For the configuration shown in FIG. 5, all of the viscosity index uplift required for the 150N basestock was achieved in the first hydrocracking stage 310. The modeled amount of viscosity index uplift for the 150N fraction of the basestock corresponded to a viscosity index uplift of about 50 to about 70. Additionally, sulfur and nitrogen were removed in the model to below 15 wppm sulfur and below 10 wppm nitrogen. Operating the hydrocracking stage in the second configuration under conditions to provide a 150N basestock with 110 viscosity index corresponded to operating the hydrocracking stage at about 47% conversion of feed to products boiling below about 370° C. In the model corresponding to FIG. 5, these lower boiling products were not passed on into the dewaxing stage. The about 53% of the products having a boiling point above 370° C. were then catalytically dewaxed to provide a pour point for all fractions that was below 0° C. The dewaxed feed was then fractionated. After fractionation, an additional about 21% of the original feed was lost as a lower boiling product, such as a fuel or a light end. After hydrocracking and dewaxing, about 16% of the original feed corresponded to a 150N basestock with a viscosity index of 110. Another about 25% of the original feed, after hydrocracking and dewaxing, corresponded to a 500N basestock. The viscosity index for the 500N basestock in the model was 122. Based on the above, the total model yield of 150N and 500N basestock was about 41%.

In the configuration corresponding to FIG. 1, the changes in the processing configuration relative to FIG. 5 allowed for an increased overall yield of basestock. For the configuration in FIG. 1, the first hydrocracking stage 110 was operated under conditions effective for reducing the sulfur content to less than 15 wppm and the nitrogen content to less than 10 wppm. The viscosity index of the 150N portion of the feed was not used as a condition for selecting severity in the first hydrocracking stage. Based on the milder conditions required for performing desulfurization and denitrogenation, the amount of conversion to products boiling below 370° C. was about 14.5%.

After the first hydrocracking stage 110, the modeled effluent was fractionated. The about 14.5% of fuels and light ends were separated out. The remaining effluent was separated into a fraction eventually suitable for use as a 150N basestock (about 62%) and a fraction suitable as a 500N basestock (about 23.5%). It is noted that the first hydrocracking stage 110 was operated under conditions less severe than the hydrocracking stage in the comparative example corresponding to FIG. 5. However, the yield of potential 500N basestock is actually lower for the configuration in FIG. 1 as compared to the configuration in FIG. 5. This is due to the lower severity hydrocracking conditions resulting in less conversion of low viscosity 370° C.+ molecules. Low viscosity 370° C.+ molecules will tend to look like paraffins, including branched paraffins. By preserving more of these molecules, a larger portion of heavier molecules can be retained in the 150N portion of the basestock while still meeting the overall viscosity requirements.

After fractionation, the potential 150N and 500N basestocks can be hydrocracked separately in a second hydrocracking stage 130. The effective conditions in the second hydrocracking stage can be selected separated for each of the potential basestocks. For the 500N basestock, little or no VI uplift was necessary, so the second hydrocracking stage conditions were selected to produce about 5% conversion. For the 150N basestock, the second hydrocracking stage conditions were selected to generate about 30% conversion in order to meet the desired VI of 110. The effluents from the second hydrocracking stage are then catalytically dewaxed in dewaxing stage 140, either separately or together. This results in additional conversion corresponding to about 15% of the original feed. The final products generated after fractionation 150 are about 31% of a 150N basestock with a VI of 110, and about 19% of a 500N basestock with a VI of 105.

Based on the above, the configuration corresponding to FIG. 1 provides a net yield increase of about 9% relative to the configuration corresponding to FIG. 5. The VI of the 500N lubricant oil basestock generated by the FIG. 1 configuration is 105, as opposed to the VI of 122 for the FIG. 5 configuration. However, for the commercial vehicle applications where a 500N basestock is often used, both VI values meet the typical standards. Thus, the configuration according to FIG. 1 allowed for an increased overall yield in exchange for a lower viscosity index for the higher viscosity basestock.

Additional Embodiments

In a first embodiment, a method for producing a plurality of basestocks is provided. The method includes: contacting a feedstock containing at least about 90 wt % of hydrocarbons boiling above 370° C. with a first hydrocracking catalyst under first effective hydrocracking conditions to produce a first hydrocracked effluent, the first hydrocracked effluent having a sulfur content of less than about 250 wppm, the first effective hydrocracking conditions being effective for conversion of about 5 wt % to about 30 wt % of the feedstock to hydrocarbons boiling below 370° C.; fractionating the first hydrocracked effluent to form a first hydrocracked fraction and a second hydrocracked fraction; contacting the first hydrocracked fraction with a second hydrocracking catalyst under second effective hydrocracking conditions to produce a third hydrocracked fraction, the third hydrocracked fraction having a viscosity index of at least about 100, the second effective hydrocracking conditions being effective for conversion of about 15 wt % to about 40 wt % of the first hydrocracked fraction to hydrocarbons boiling below 370° C.; contacting the second hydrocracked fraction with a hydrocracking catalyst under third effective hydrocracking conditions to produce a fourth hydrocracked fraction, the fourth hydrocracked fraction having a viscosity index less than the viscosity index of the third hydrocracked fraction, the third effective hydrocracking conditions being effective for conversion of about 5 wt % to about 15 wt % of the second hydrocracked fraction to hydrocarbons boiling below 370° C.; dewaxing the third hydrocracked fraction and the fourth hydrocracked fraction under effective catalytic dewaxing conditions in the presence of a dewaxing catalyst; and fractionating the third dewaxed hydrocracked fraction and the fourth dewaxed hydrocracked fraction to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

In a second embodiment, a method for producing a plurality of basestocks is provided. The method includes: contacting a feedstock containing at least about 90 wt % of hydrocarbons boiling above 370° C. with a first hydrocracking catalyst under first effective hydrocracking conditions to produce a first hydrocracked effluent, the first hydrocracked effluent having a sulfur content of less than about 250 wppm, the first effective hydrocracking conditions being effective for conversion of about 5 wt % to about 30 wt % of the feedstock to hydrocarbons boiling below 370° C.; fractionating the first hydrocracked effluent to form a first hydrocracked fraction and a second hydrocracked fraction; dewaxing the first hydrocracked fraction and the second hydrocracked fraction under effective catalytic dewaxing conditions in the presence of a dewaxing catalyst; contacting the first dewaxed hydrocracked fraction with a second hydrocracking catalyst under second effective hydrocracking conditions to produce a third dewaxed hydrocracked fraction, the third dewaxed hydrocracked fraction having a viscosity index of at least about 100, the second effective hydrocracking conditions being effective for conversion of about 15 wt % to about 40 wt % of the first dewaxed hydrocracked fraction to hydrocarbons boiling below 370° C.; contacting the second dewaxed hydrocracked fraction with a third hydrocracking catalyst under third effective hydrocracking conditions to produce a fourth dewaxed hydrocracked fraction, the fourth dewaxed hydrocracked fraction having a viscosity index less than the viscosity index of the third dewaxed hydrocracked fraction, the third effective hydrocracking conditions being effective for conversion of about 5 wt % to about 15 wt % of the second dewaxed hydrocracked fraction to hydrocarbons boiling below 370° C.; and fractionating the third dewaxed hydrocracked fraction and the fourth dewaxed hydrocracked fraction to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

In a third embodiment, a method according to any of the above embodiments is provided, wherein fractionating the first hydrocracked effluent to form a first hydrocracked fraction comprises forming a first hydrocracked fraction with a viscosity of about 3.0 cSt to about 7.0 cSt.

In a fourth embodiment, a method according to any of the above embodiments is provided, further comprising storing the second hydrocracked fraction during said contacting of the first hydrocracked fraction with the second hydrocracking catalyst.

In a fifth embodiment, a method according to the first, second, or third embodiments is provided, wherein the second hydrocracking catalyst is located in a second hydrocracking stage, and wherein the second hydrocracked fraction is introduced into the second hydrocracking stage at a location downstream from the first hydrocracked fraction, the third hydrocracking catalyst corresponding to a portion of the second hydrocracking catalyst that is downstream from the location for introducing the second hydrocracked fraction.

In a sixth embodiment, a method for producing a plurality of basestocks is provided. The method includes fractionating a feedstock containing at least about 90 wt % of hydrocarbons boiling above 370° C. to form a first fraction having a viscosity of less than 7 cSt at 100° C. and a second fraction; contacting the first fraction with an initial portion of a first hydrocracking catalyst under first effective hydrocracking conditions in a first reaction stage to produce a partially hydrocracked first fraction, the first hydrocracking catalyst comprising the initial portion and a remaining portion; introducing the second fraction into the first reaction stage at a location downstream from the initial portion of the first hydrocracking catalyst; contacting the partially hydrocracked first fraction and the second fraction with the remaining portion of the first hydrocracking catalyst under first effective hydrocracking conditions in the first reaction stage to produce a hydrocracked effluent, the hydrocracked effluent comprising a first basestock fraction and a second basestock fraction, the hydrocracked effluent having a sulfur content of less than about 250 wppm, the first effective hydrocracking conditions being effective for conversion of about 5 wt % to about 30 wt % of the feedstock to hydrocarbons boiling below 370° C.; optionally performing a gas-liquid separation on the hydrocracked effluent; dewaxing the hydrocracked effluent under effective catalytic dewaxing conditions in the presence of a dewaxing catalyst; and fractionating the dewaxed hydrocracked effluent to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

In a seventh embodiment, a method according to the sixth embodiment is provided, further comprising fractionating the hydrocracked effluent to form a first hydrocracked fraction, a second hydrocracked fraction, a gas phase fraction, and a fraction having a lower boiling point than the first basestock fraction and the second basestock fraction prior to said dewaxing, wherein dewaxing the hydrocracked effluent comprises dewaxing the first hydrocracked fraction and dewaxing the second hydrocracked fraction.

In an eighth embodiment, a method according to the sixth or seventh embodiments is provided, further comprising contacting the hydrocracked effluent with a second hydrocracking catalyst under second effective hydrocracking conditions prior to dewaxing the hydrocracked effluent or after dewaxing the hydrocracked effluent.

In a ninth embodiment, a method according to any of the above embodiments is provided, wherein the first basestock has a Saybolt Uniform Seconds viscosity of about 100N to about 250N and/or a viscosity index of at least about 110, and wherein the second basestock has a viscosity index of about 105 or less, preferably about 95 or less.

In a tenth embodiment, a method according to any of the above embodiments is provided, wherein the feedstock has an initial boiling point of at least about 350° C. and a final boiling point of about 649° C. or less.

In an eleventh embodiment, a method according to any of the above embodiments is provided, wherein the first effective hydrocracking conditions comprise a temperature of about 200° C. to about 450° C., hydrogen partial pressures of from about 250 psig to about 5000 psig (1.8 MPa to 34.6 MPa), liquid hourly space velocities of from about 0.2 $h^{-1}$ to about 10 $h^{-1}$, and hydrogen treat gas rates of from about 35.6 $m^3/m^3$ to about 1781 $m^3/m^3$ (200 SCF/B to 10,000 SCF/B).

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for producing a plurality of basestocks, comprising:

contacting a feedstock containing at least about 90 wt % of hydrocarbons boiling above 370° C., the feedstock having at least one of a T95 boiling point of 621° C. or less or a final boiling point of 649° C. or less, with a first hydrocracking catalyst under first effective hydrocracking conditions to produce a first hydrocracked effluent, the first hydrocracked effluent having a sulfur content of less than about 250 wppm, the first effective hydrocracking conditions being effective for conversion of about 5 wt % to about 30 wt % of the feedstock to hydrocarbons boiling below 370° C.;

fractionating the first hydrocracked effluent to form a first hydrocracked fraction and a second hydrocracked fraction contacting the first hydrocracked fraction with a second hydrocracking catalyst under second effective hydrocracking conditions to produce a third hydrocracked fraction, the third hydrocracked fraction having a viscosity index of at least about 100, the second effective hydrocracking conditions being effective for conversion of about 15 wt % to about 40 wt % of the first hydrocracked fraction to hydrocarbons boiling below 370° C.;

contacting the second hydrocracked fraction with a third hydrocracking catalyst under third effective hydrocracking conditions to produce a fourth hydrocracked fraction, the fourth hydrocracked fraction having a viscosity index less than the viscosity index of the third hydrocracked fraction, the third effective hydrocracking conditions being effective for conversion of about 5 wt % to about 15 wt % of the second hydrocracked fraction to hydrocarbons boiling below 370° C.;

dewaxing the third hydrocracked fraction and the fourth hydrocracked fraction under effective catalytic dewaxing conditions in the presence of a dewaxing catalyst; and fractionating the third dewaxed hydrocracked fraction and the fourth dewaxed hydrocracked fraction to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

2. The method of claim 1, wherein the first basestock has a Saybolt Uniform Seconds viscosity of about 100N to about 250N.

3. The method of claim 1, wherein the feedstock has an initial boiling point of at least about 350° C.

4. The method of claim 1, wherein fractionating the first hydrocracked effluent to form a first hydrocracked fraction comprises forming a first hydrocracked fraction with a viscosity of about 3.0 cSt to about 7.0 cSt.

5. The method of claim 1, wherein fractionating the first hydrocracked effluent further forms a bottoms fraction.

6. The method of claim 1, wherein the first effective hydrocracking conditions comprise a temperature of about 200° C. to about 450° C., hydrogen partial pressures of from about 250 psig to about 5000 psig (1.8 MPa to 34.6 MPa), liquid hourly space velocities of from about 0.2 $h^{-1}$ to about 10 $h^{-1}$, and hydrogen treat gas rates of from about 35.6 $m^3/m^3$ to about 1781 $m^3/m^3$ (200 SCF/B to 10,000 SCF/B).

7. The method of claim 1, wherein the third hydrocracked fraction has a viscosity of about 3.0 cSt to about 7.0 cSt.

8. The method of claim 1, wherein at least one of the first basestock or the third hydrocracked fraction has a viscosity index of at least about 110.

9. The method of claim 8, wherein at least one of the second basestock or the fourth hydrocracked fraction has a viscosity index of about 105 or less.

10. The method of claim 1, wherein the first basestock has a viscosity of about 4.0 cSt to about 6.5 cSt.

11. The method of claim 1, further comprising storing the second hydrocracked fraction during said contacting of the first hydrocracked fraction with the second hydrocracking catalyst.

12. The method of claim 1, wherein the second hydrocracking catalyst is located in a second hydrocracking stage and the third hydrocracking catalyst is located in a third hydrocracking stage, the second hydrocracking catalyst and third hydrocracking catalyst comprising the same catalyst.

13. The method of claim 1, wherein the second hydrocracking catalyst is located in a second hydrocracking stage, and wherein the second hydrocracked fraction is introduced into the second hydrocracking stage at a location downstream from the first hydrocracked fraction, the third hydrocracking catalyst corresponding to a portion of the second hydrocracking catalyst that is downstream from the location for introducing the second hydrocracked fraction.

14. A method for producing a plurality of basestocks, comprising:

contacting a feedstock containing at least about 90 wt % of hydrocarbons boiling above 370° C., the feedstock having at least one of a T95 boiling point of 621° C. or less or a final boiling point of 649° C. or less, with a first hydrocracking catalyst under first effective hydrocracking conditions to produce a first hydrocracked effluent, the first hydrocracked effluent having a sulfur content of less than about 250 wppm, the first effective hydrocracking conditions being effective for conversion of about 5 wt % to about 30 wt % of the feedstock to hydrocarbons boiling below 370° C.;

fractionating the first hydrocracked effluent to form a first hydrocracked fraction and a second hydrocracked fraction dewaxing the first hydrocracked fraction and the second hydrocracked fraction under effective catalytic dewaxing conditions in the presence of a dewaxing catalyst;

contacting the first dewaxed hydrocracked fraction with a second hydrocracking catalyst under second effective hydrocracking conditions to produce a third dewaxed hydrocracked fraction, the third dewaxed hydrocracked fraction having a viscosity index of at least about 100, the second effective hydrocracking conditions being effective for conversion of about 15 wt % to about 40 wt % of the first dewaxed hydrocracked fraction to hydrocarbons boiling below 370° C.;

contacting the second dewaxed hydrocracked fraction with a third hydrocracking catalyst under third effective hydrocracking conditions to produce a fourth dewaxed hydrocracked fraction, the fourth dewaxed hydrocracked fraction having a viscosity index less than the viscosity index of the third dewaxed hydrocracked fraction, the third effective hydrocracking conditions being effective for conversion of about 5 wt % to about 15 wt % of the second dewaxed hydrocracked fraction to hydrocarbons boiling below 370° C.; and fractionating the third dewaxed hydrocracked fraction and the fourth dewaxed hydrocracked fraction to form a first basestock and a second basestock, the first basestock having a viscosity of about 3.0 cSt to about 7.0 cSt at 100° C. and a Noack volatility of about 20 or less, the second basestock having a viscosity of about 8.0 cSt to about 12.0 cSt at 100° C.

15. The method of claim 14, wherein fractionating the third dewaxed hydrocracked fraction and the fourth dewaxed hydrocracked fraction further comprises forming a diesel fraction.

16. The method of claim 14, wherein the second hydrocracking catalyst is located in a second hydrocracking stage, and wherein the second dewaxed hydrocracked fraction is introduced into the second hydrocracking stage at a location downstream from the first dewaxed hydrocracked fraction, the third hydrocracking catalyst corresponding to the portion of the second hydrocracking catalyst that is downstream from the location for introducing the second hydrocracked fraction.

* * * * *